US006579034B1

(12) United States Patent
Welch et al.

(10) Patent No.: US 6,579,034 B1
(45) Date of Patent: Jun. 17, 2003

(54) HIGHWAY CRASH ATTENUATOR FRAME

(75) Inventors: James B. Welch, Placerville, CA (US); Lincoln C. Cobb, Auburn, CA (US)

(73) Assignee: Energy Absorption Systems, Inc., Chicago, IL (US)

( * ) Notice: Subject to any disclaimer, the term of this patent is extended or adjusted under 35 U.S.C. 154(b) by 0 days.

(21) Appl. No.: 10/025,025

(22) Filed: Dec. 19, 2001

(51) Int. Cl.[7] ..... E01F 15/00
(52) U.S. Cl. ..... 404/6; 256/13.1
(58) Field of Search ..... 404/6; 256/13.1; 188/377; 293/132, 133

(56) References Cited

U.S. PATENT DOCUMENTS

| | | | | |
|---|---|---|---|---|
| 3,972,390 A | * | 8/1976 | Melton et al. | 188/377 |
| 4,635,981 A | | 1/1987 | Friton | |
| 5,052,732 A | | 10/1991 | Oplet et al. | |
| 5,248,129 A | | 9/1993 | Gertz | |
| 5,551,796 A | | 9/1996 | Anderson, Jr. et al. | |
| 5,642,792 A | | 7/1997 | June | |
| 5,947,452 A | | 9/1999 | Albritton | |
| 6,092,959 A | | 7/2000 | Leonhardt et al. | |
| 6,098,767 A | | 8/2000 | Unrath | |
| 6,183,042 B1 | | 2/2001 | Unrath | |
| 6,186,565 B1 | | 2/2001 | Unrath | |
| 6,244,637 B1 | | 6/2001 | Leonhardt et al. | |
| 6,481,920 B1 | * | 11/2002 | Leonhardt et al. | 404/6 |

OTHER PUBLICATIONS

Photographs 1–4 of truck mounted attenuator used in the U.S. before Sep. 28, 2001.

Copy of U.S. application Ser. No.: 10/002/833 entitled "Vehicle Mounted Crash Attenuator" filed Nov. 1, 2001.

* cited by examiner

*Primary Examiner*—Robert E. Pezzuto
*Assistant Examiner*—Kristine M. Florio
(74) *Attorney, Agent, or Firm*—Brinks Hofer Gilson & Lione

(57) ABSTRACT

A highway crash attenuator frame includes transverse elements that are interconnected by side elements. Each side element is disposed entirely on a respective side of a central longitudinal axis of the frame, and one or more tension elements are secured to the side elements to extend between the side elements across the longitudinal axis. Each tension element includes a mechanical fuse operative to fail in tension when the first and second side elements supply an excessive tensile load to the tension element. When the mechanical fuse fails in tension in an impact, the side elements are simultaneously released to move outwardly, away from the longitudinal axis, and thereby to collapse in a way which is coordinated between the left and the right sides of the frame.

9 Claims, 2 Drawing Sheets

10
12
14
16
18
20
22
24
26
28
30
32
34
36
37
38
39
40
42
44
46
48
50
L

HIGHWAY CRASH ATTENUATOR FRAME

BACKGROUND

The present invention relates to frames for highway crash attenuators such as truck mounted attenuators.

June U.S. Pat. No. 5,642,792 and Leonhardt U.S. Pat. No. 6,092,959 disclose highway crash cushions intended to be mounted on a shadow vehicle such as a truck. In both cases, the disclosed crash cushions include frames having transverse elements interconnected by side elements. The side elements are articulated such that they can fold outwardly to allow the frame to collapse in an impact. Premature collapse of the frame is prevented by restraints coupled to the side elements. In the June patent, these restraints include diagonally oriented cables extending between the center portions of the side elements and one of the transverse elements. These cables prevent the side elements from moving outwardly until they are released by rotation of pins that secure the cables to the transverse element. In the Leonhardt patent, the restraints take the form of bolts secured between adjacent central portions of the side elements, on either side of the respective central hinges. The central hinges of the side elements are prevented from opening until after the bolts have been broken during an impact.

Though effective in operation, the diagonal cables of the June patent may not be optimal for applications that do not use a probe to initiate collapse of the frame. Because the bolts used to hold the frame of the Leonhardt patent in the original position are each responsive only to forces at the respective central hinge, the opening of the hinges on opposed sides of the frame are not coordinated with one another.

Gertz U.S. Pat. No. 5,248,129 describes another frame that includes a scissors linkage that is held in an initial position by cables that extend between bars positioned across the frame at the upper and lower hinges of the linkage. The Gertz patent relates to a different type of linkage in which rigid bars cross between the top and the bottom of the frame to form the scissors linkage.

SUMMARY

By way of general introduction, the highway crash attenuator frame described below includes one or more tension elements secured between opposed side elements near the respective central hinges. Each tension element extends across the longitudinal axis of the frame, from one side of the frame to the other side of the frame. Each tension element includes a mechanical fuse that fails in tension when the first and second side elements of the frame apply an excessive load to the tension element. Once the mechanical fuse fails, central hinges on both sides of the frame are simultaneously allowed to begin opening. In this way, the collapse of the frame is coordinated between the left and right sides of the frame.

The foregoing paragraphs have been intended by way of general introduction, and they are not intended to narrow the scope of the following claims in any way.

DETAILED DESCRIPTION OF THE DRAWINGS

Figures 1, 2, 3:
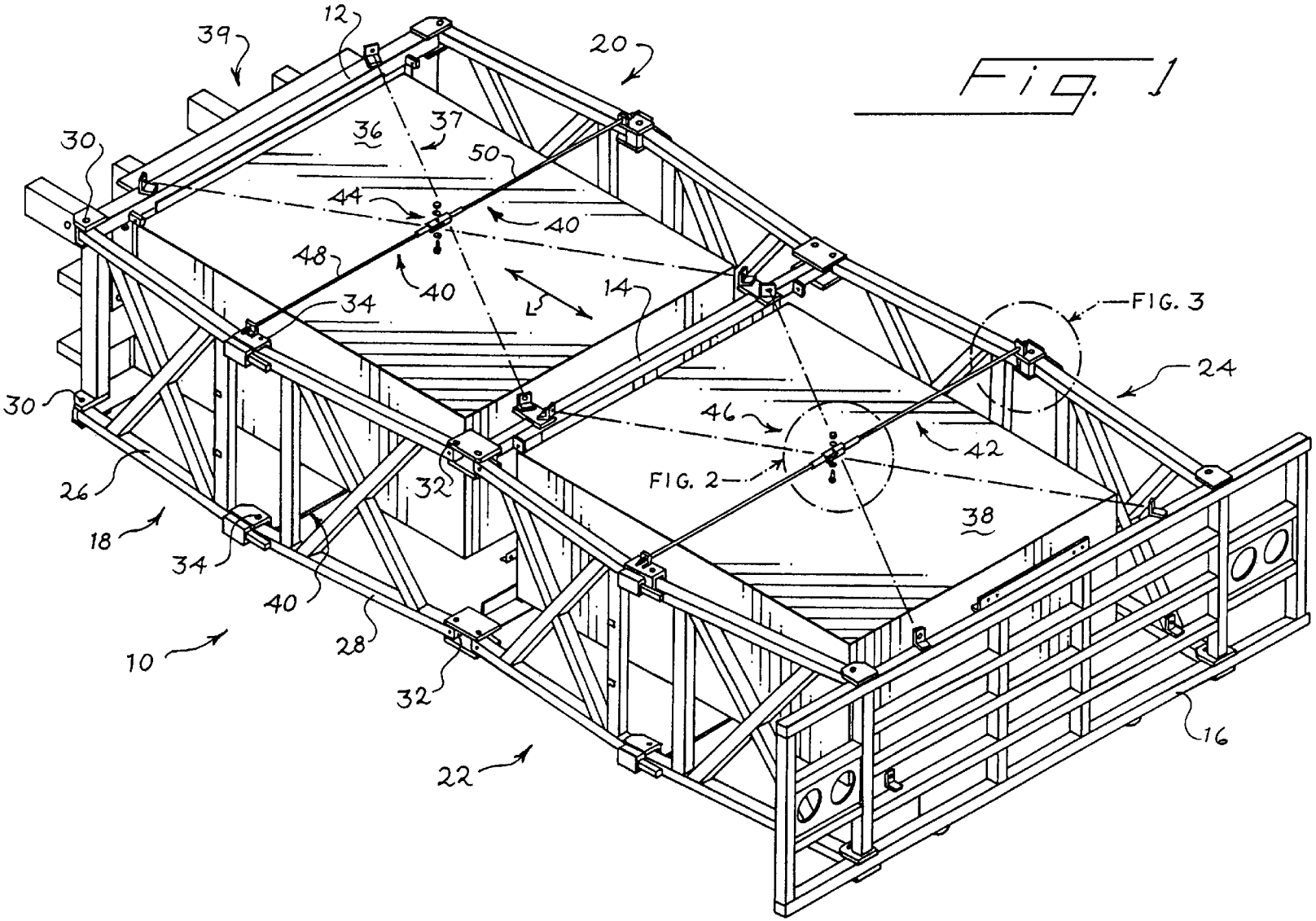
FIG. 1 is an isometric view of a highway crash attenuator frame that incorporates a preferred embodiment of this invention.
FIGS. 2 and 3 are enlarged views of the corresponding encircled regions of FIG. 1.
Figure 3:
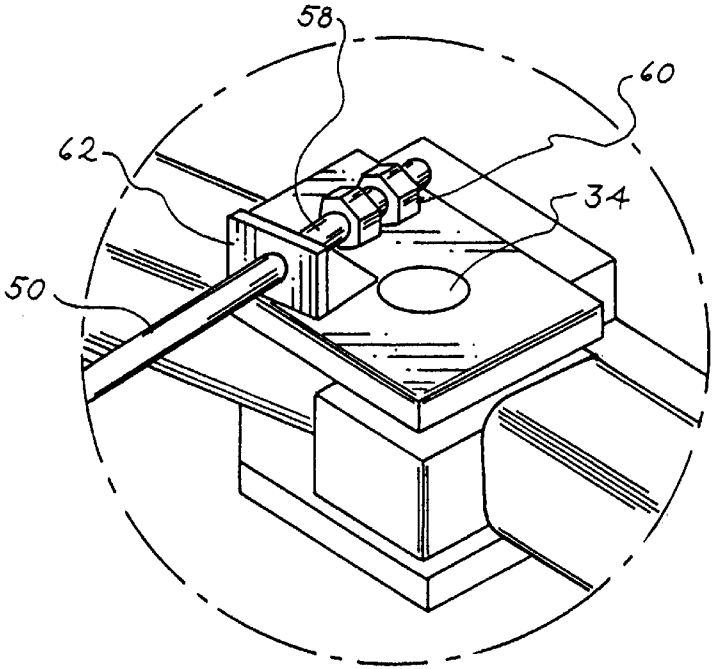
Figure 2:
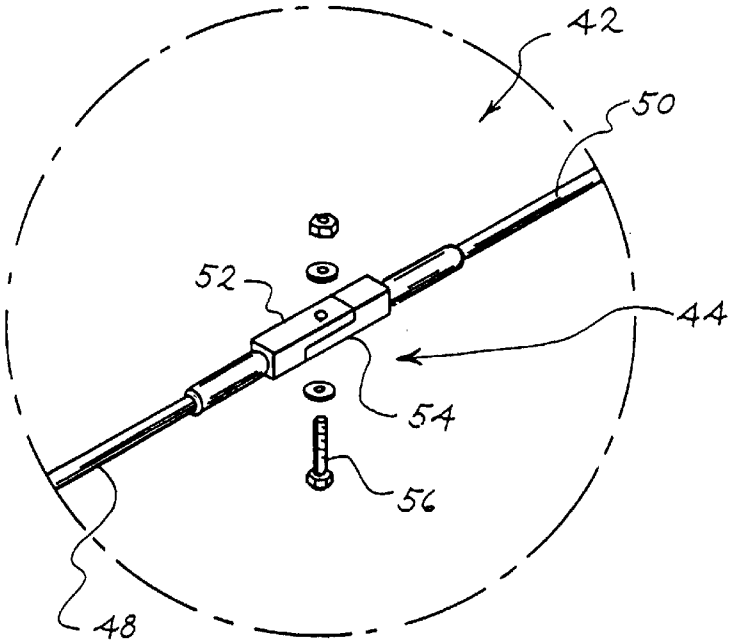

Turning now to the drawings, FIG. 1 shows a highway crash attenuator frame 10 that includes first, second and third transverse elements 12, 14, 16 that are spaced along a central longitudinal axis L. In this example, the transverse elements are shown as frames, but in alternative embodiments they may be implemented as solid panels. In general, the transverse elements can take many forms, including one-piece elements and assemblies of component parts.

The first and second transverse elements 12, 14 are interconnected by a first side element 18 on a first side of the central longitudinal axis L and a second side element 20 on a second, opposed side of the longitudinal axis L. Similarly, the second and third transverse elements 14, 16 are interconnected by a third side element 22 positioned entirely on one side of the longitudinal axis L and a fourth side element 24 positioned entirely on the opposite side of the longitudinal axis L.

In this example, the side elements 18, 20, 22, 24 are shown as articulated frames, but it should be understood that many alternatives are possible. The side elements may be formed of panels or individual rods, with or without the hinges described below. When hinges are used, they can be formed as living hinges or as multiple-part hinges. In some cases, the side elements may be rigid rods, bars, or tubes extending between adjacent transverse elements and shaped to fail in a predictable way during an impact.

In the example of FIG. 1, the four side elements 18, 20, 22, 24 are identical, and one of the side elements 18 will be taken as representative. The side element 18 includes a first frame 26 and a second frame 28. The first frame 26 is connected by first hinges 30 to the first transverse element 12, and the second frame 28 is connected by second hinges 32 to the second transverse element 14. The first and second frames 26, 28 are connected together by center hinges 34. The hinges 30, 32, 34 are oriented to permit the frames 26, 28 to hinge outwardly (away from the longitudinal axis L) when the frame 10 collapses in an impact.

The frame 10 defines first and second bays surrounded by the transverse elements 12, 14, 16 and the side elements 18, 20, 22, 24. First and second energy absorbers 36, 38 are positioned in the first and second bays, respectively. When the frame 10 collapses in an impact, the energy absorbers 36, 38 are axially collapsed, thereby providing deceleration forces that slow the impacting vehicle.

The energy absorbers 36, 38 can take many forms, and the energy absorbers described in Leonhardt U.S. Pat. No. 6,092,959 patent can be taken as examples. It is not required in all embodiments that an energy absorber be placed within the frame 10, and in some examples the energy absorbing characteristics of the frame itself are sufficient to provide the desired decelerating forces.

In FIG. 1, diagonal cable braces 37 are shown in dotted lines in order to make FIG. 1 more readable. These diagonal braces 37 improve rigidity of the frame 10 prior to collapse, without impeding collapse in an impact. Typically, the diagonal braces 37 are formed as flexible cables.

The first transverse element 12 is secured to a mounting arrangement 39 that is adapted to cantilever the frame 10 from the rear of a shadow vehicle such as a truck.

The elements 12 through 39 described above may take many forms, and they may, for example, be formed as described in Leonhardt U.S. Pat. No. 6,092,959, assigned to the assignee of the present invention and hereby incorporated by reference in its entirety.

One important difference between the frame 10 and the frame shown in the Leonhardt patent relates to the first and second tension elements 40, 42. Each of the tension elements 40, 42 includes a respective mechanical fuse 44, 46, and the mechanical fuses 44, 46 hold the respective tension elements 40, 42 intact until a tensile load is placed on the tensile elements that exceeds a predetermined threshold value. When this occurs, the mechanical fuses 44, 46 separate, thereby decoupling the opposed side elements 18, 20; 22, 24.

The function of the tension elements 40, 42 is to hold the frame 10 in the position of FIG. 1 until collapsing loads are applied parallel to the longitudinal axis L in an impact. These collapsing loads tend to cause the side elements 18, 20, 22, 24 to bow outwardly (away from the longitudinal axis L) by rotation of the respective hinges. As long as the tension elements 40, 42 are intact, they limit the maximum separation between the respective center hinges 34, and thereby prevent the frame 10 from collapsing. Once the mechanical fuses 44, 46 separate, the side elements 18, 22 on the first side of the longitudinal axis L are no longer coupled with the respective side elements 20, 24 on the second side of the longitudinal axis L, and the side elements are free to move outwardly. Because the tension elements 40, 42 cross the longitudinal axis L and are secured between opposed side elements, the tension elements 40, 42 insure that the side elements on both sides of the longitudinal axis L are freed to collapse outwardly at the same instant (within any given bay).

Figure 4:
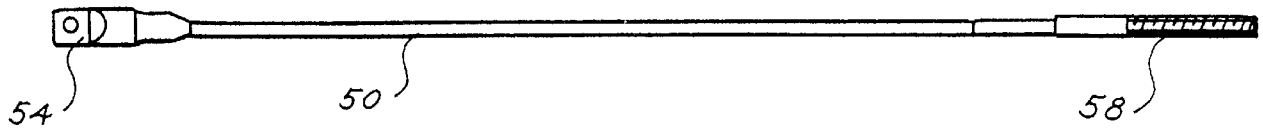
FIG. 4 is a top view of a portion of one of the tension elements of FIG. 1.

FIGS. 2 through 4 provide further information regarding the tension elements 40, 42. In this example, the tension elements 40, 42 are identical, and the following discussion will focus on the tension element 42.

As shown in FIG. 2, the tension element 42 includes first and second cables 48, 50 that are secured at their central ends to respective overlapping elements 52, 54. The overlapping elements 52, 54 define aligned openings, and a shear pin 56 passes through the aligned openings. The shear pin 56 in this example is oriented perpendicularly to the cables 48, 50 and is implemented as a threaded bolt.

The outboard ends of the cables 48, 50 terminate in respective threaded shafts 58. The threaded shafts 58 pass through openings in flanges 62 secured to the side elements adjacent the respective center hinges 34. Adjusting nuts 60 are threaded onto the threaded shafts 58 to adjust the effective lengths of the cables 48, 50 and therefore of the tension element 42.

The overlapping elements 52, 54 and the shear pin 56 should be understood as only one example of a suitable mechanical fuse. Many alternatives are possible, including mechanical fuses using two or more shear pins and mechanical fuses using elements designed to fail in tension rather than in shear. The mechanical fuse can also be implemented by selecting a cable that parts at a selected load, a connection between the cable and an attachment element (such as the threaded shaft 58) that fails at a selected load, or the like. In this case, the mechanical fuse is integrated into the tension element, and a single part (e.g. a cable) serves as both the tension element and as the mechanical fuse. The mechanical fuses 44, 46 can be designed to separate at the same tensile load, or at different tensile loads, depending upon the desired mode of collapse of the frame 10.

As shown in FIG. 1, tension elements 40, 42 are provided above and below the respective energy absorbers 36, 48. Thus, there are two tension elements 40 extending laterally between the side elements 18, 20, and there are two tension elements 42 extending laterally between the side elements 22, 24.

By way of example, the following details of construction are provided to clearly define the presently preferred embodiment. These details of construction of course are not intended to limit the scope of the following claims in any way. In this example, the first and second cables 48, 50 are implemented as wire rope meeting federal specification RR-W-410 (5/16 inch diameter, 7×19 galvanized). The threaded shaft 58 is 5/8 inch in diameter, and has 11 threads per inch. The shear pin 56 is a 5/8 inch diameter Grade 2 bolt. The adjusting nuts 60 are tightened to tension the tension element 40, and thereby to hold the frame 10 in the position of FIG. 1 prior to an impact. Though FIG. 1 shows physical structure adjacent the center hinges 38 of the type used to receive trigger bolts in the above-identified Leonhardt patent, no trigger bolts are preferably used, and in this example the only forces holding the center hinges closed are supplied by the tension elements 40, 42.

As used herein, the term "set" is intended to mean one or more. Thus, a set of hinges can include 1, 2, 3 or more hinges. The term "pin" is intended broadly to encompass rods of various types, whether threaded or not, and a shear pin may be implemented as a threaded bolt as described above.

The foregoing detailed description has discussed only a few of the many forms that this invention can take. This description is therefore intended by way of illustration, and not by way of limitation. It is only the following claims, including all equivalents, that are intended to define the scope of this invention.

What is claimed is:

1. A highway crash attenuator frame comprising:

first and second transverse elements spaced along a central longitudinal axis;

a first side element extending between the first and second transverse elements, said first side element disposed entirely on a first side of the longitudinal axis;

a second side element extending between the first and second transverse elements, said second side element disposed entirely on a second side of the longitudinal axis, opposite the first side;

a tension element secured to the first and second side elements and extending between the first and second side elements across the longitudinal axis, said tension element comprising a mechanical fuse operative to fail in tension when the first and second side elements apply an excessive load to the tension element.

2. The invention of claim 1 further comprising an energy absorber disposed between the transverse elements and between the side elements.

3. The invention of claim 1 wherein the side elements each comprise first and second frames secured together by a set of center hinges, each first frame secured to the first transverse element by a set of first hinges, and each second frame secured to the second transverse element by a set of second hinges.

4. The invention of claim 3 wherein the tension element is secured to the side elements adjacent to the center hinges.

5. The invention of claim 1 wherein the mechanical fuse comprises first and second overlapping elements and a shear pin passing through the overlapping elements.

6. The invention of claim 5 wherein the tension element further comprises a first cable secured at one end to the first side element and at an opposite end to the first overlapping element, and a second cable secured at one end to the second side element and at an opposite end to the second overlapping element.

7. The invention of claim 6 wherein the cables are oriented transversely to the shear pin.

8. The invention of claim 1 further comprising:

a mounting arrangement secured to one of the transverse elements and adapted to mount the crash attenuator frame to a shadow vehicle.

9. The invention of claim 1 further comprising:

a third transverse element;

a third side element extending between the second and third transverse elements, said third side element disposed entirely on the first side of the longitudinal axis;

a fourth side element extending between the second and third transverse elements, said fourth side element disposed entirely on the second side of the longitudinal axis;

a second tension element secured to the third and fourth side elements and extending between the third and fourth side elements across the longitudinal axis, said second tension element comprising a second mechanical fuse operative to fail in tension when the third and fourth side elements apply an excessive load to the second tension element.

* * * * *